United States Patent [19]

Zimber et al.

[11] Patent Number: 4,509,330

[45] Date of Patent: Apr. 9, 1985

[54] PNEUMATICALLY CONTROLLED PRESSURE TRANSDUCER FOR OPERATING HYDRAULIC WORK TOOLS

[75] Inventors: Béla Zimber, Budapest; Imre Molnár, Székesfehérvár, both of Hungary

[73] Assignee: Kozponti Valto, Budapest, Hungary

[21] Appl. No.: 483,949

[22] PCT Filed: Aug. 4, 1982

[86] PCT No.: PCT/HU82/00037

§ 371 Date: Apr. 4, 1983

§ 102(e) Date: Apr. 4, 1983

[87] PCT Pub. No.: WO83/00540

PCT Pub. Date: Feb. 17, 1983

[30] Foreign Application Priority Data

Aug. 4, 1981 [HU] Hungary ..... 2257/81

[51] Int. Cl.[3] ..... F15B 7/08

[52] U.S. Cl. ..... 60/537; 60/547.1; 60/560; 60/563; 60/593

[58] Field of Search ..... 60/537, 547.1, 560, 60/563, 565, 593, 540; 91/308, 318, 461

[56] References Cited

U.S. PATENT DOCUMENTS

| | | | |
|---|---|---|---|
| 1,940,304 | 12/1933 | Jackson | 60/560 |
| 2,169,423 | 8/1939 | Kessler et al. | 60/563 |
| 3,407,601 | 10/1968 | Beck | 60/565 |
| 3,638,532 | 2/1972 | Novak | 91/308 |
| 4,288,987 | 9/1981 | Grüllmeier | 60/560 |

FOREIGN PATENT DOCUMENTS

| | | | |
|---|---|---|---|
| 3032430 | 3/1982 | Fed. Rep. of Germany | 60/593 |
| 767410 | 9/1980 | U.S.S.R. . | |
| 907319 | 2/1982 | U.S.S.R. . | |

*Primary Examiner*—Robert E. Garrett
*Attorney, Agent, or Firm*—Handal & Morofsky

[57] ABSTRACT

The invention relates to a pneumatically controlled pressure transducer for operating hydraulic work tools having a dual operating cylinder, on one side of which a pneumatically operable piston, on the other side a hydraulically operable piston is provided and, to the hydraulic side of which a hydraulically operable working tool can be joined.

The essence of the invention resides in that a control valve is provided which is coupled with the primary space located in front of the piston of the pneumatically operable cylinder of the operating cylinder and, which is connected into an operating relationship with a starting valve, and wherein the control valve is connected over a throttle-check valve to a further valve on one side, while on the other side, over a quick exhaust valve, is connected with a hydraulic container, respectively, over a valve with the secondary space of the pneumatically operable cylinder.

A further essential characteristic resides in that the control valve is coupled over the throttle-check valve of the hydraulic container with the hydraulic cylinder of the dual operating cylinder in a fashion which can be closed with the hydraulic piston. Between the valve and the cylinder, there is a conduit which is coupled over a further throttle-check valve with the control valve into an operating relationship.

The pressure transducer according to the invention represents a relatively inexpensive apparatus having a uniformly simple construction with the help of which various hydraulic work tools can be operated in a manner determined by the operating tool itself and the object to be solved thereby.

4 Claims, 12 Drawing Figures

PNEUMATICALLY CONTROLLED PRESSURE TRANSDUCER FOR OPERATING HYDRAULIC WORK TOOLS

The invention relates to a pneumatically controlled pressure transducer for the operation of hydraulic wook tools having a dual operating cylinder on one side of which there is provided a pneumatically operated piston, on the other side, a hydraulically operated piston, and on the hydraulic side, there are provided hydraulically working tools joined thereto.

In the industry and also in certain special areas, there is a real need for the processing of various materials, such work processes are, for example, the cutting-up, the cutting-off, the sheet metal forming, tensioning, pressing, riveting, driving in screws, drawing, hub removing, etc. Such assignments are performed with the help of various special machines. The price of such special machine is very high and the use of such machine becomes economical only when there is a continuous need to perform the operating process by such machine. On the other hand, the hand tools serving the various purposes can be used only in a limited manner due to the limited nature of their highest force which they can output.

The object of the invention is to eliminate the noted disadvantages and to provide a uniform arrangement with which the various hydraulically operated tools can be operated in a certain operating mode, as required by the work to be performed and, after exchanging the working tool, it could be easily adjusted to the new operating tool. With a view that such operating tool should be preferably hydraulically operated, the invention sets its objective to provide the hydraulic operation with an appropriate control.

The invention, therefore, relates to a pneumatically controlled pressure transducer for the operation of hydraulic work tools having a dual operating cylinder, on one side of which there is provided a pneumatically operable piston, on the other side of which there is provided a hydraulically operable piston and, on the hydraulic side is a hydraulic work tool joined.

The essence of the invention resides in that with a primary space located before the piston of the pneumatically operated cylinder of the dual operating cylinder, a two postion, four or five-way control valve is coupled which is in an operating relationship with a starting valve, and such control valve is coupled over a throttle-check valve with a shuttle valve and, on the other side, over a waste or exhaust valve, it is coupled with a hydraulic container, that is, over the valve it is coupled with the secondary space of the pneumatic cylinder. The hydraulic container is coupled over the throttle-check valve with the hydraulic cylinder of the dual operating cylinder in a manner which can be shut off by the hydraulic piston. The conduit between the valve and the throttle-check valve is coupled to the control valve over a further throttle-check valve. It is preferred to provide a valve between the starting valve and the control valve which is operated by the pressure existing in the conduit between the valve and the pneumatic cylinder. The setting of the various operating tools and their corresponding operating processes is performed with the throttle-check valve, therefore, they are provided at least partially with an adjustable throttling means. With the pressure transducer according to the invention, one may use operating tools for riveting, pressing, cutting-up, sheet metal forming, lifting, tensioning, screw driving, hub removing. By the setting of the throttle-check valve, one may set the operating process which corresponds to each of the above noted needs, so that one may set with any desired speed the quick running of the operating step requiring a very high force, such as cutting-off sheet metals, lifting, etc., including the resetting of the work tool. It is understood that the various operating processes can be varied according to the need and desire. The provision of the pressurized air for the pressure transducer is done by the air preparator (cooling, decompression, oil lubrication) with a view that the longest possible operating life could be obtained.

The invention will be further explained on hand of the attached drawings, with the help of an embodiment. They illustrate as follows.

Figure 3:
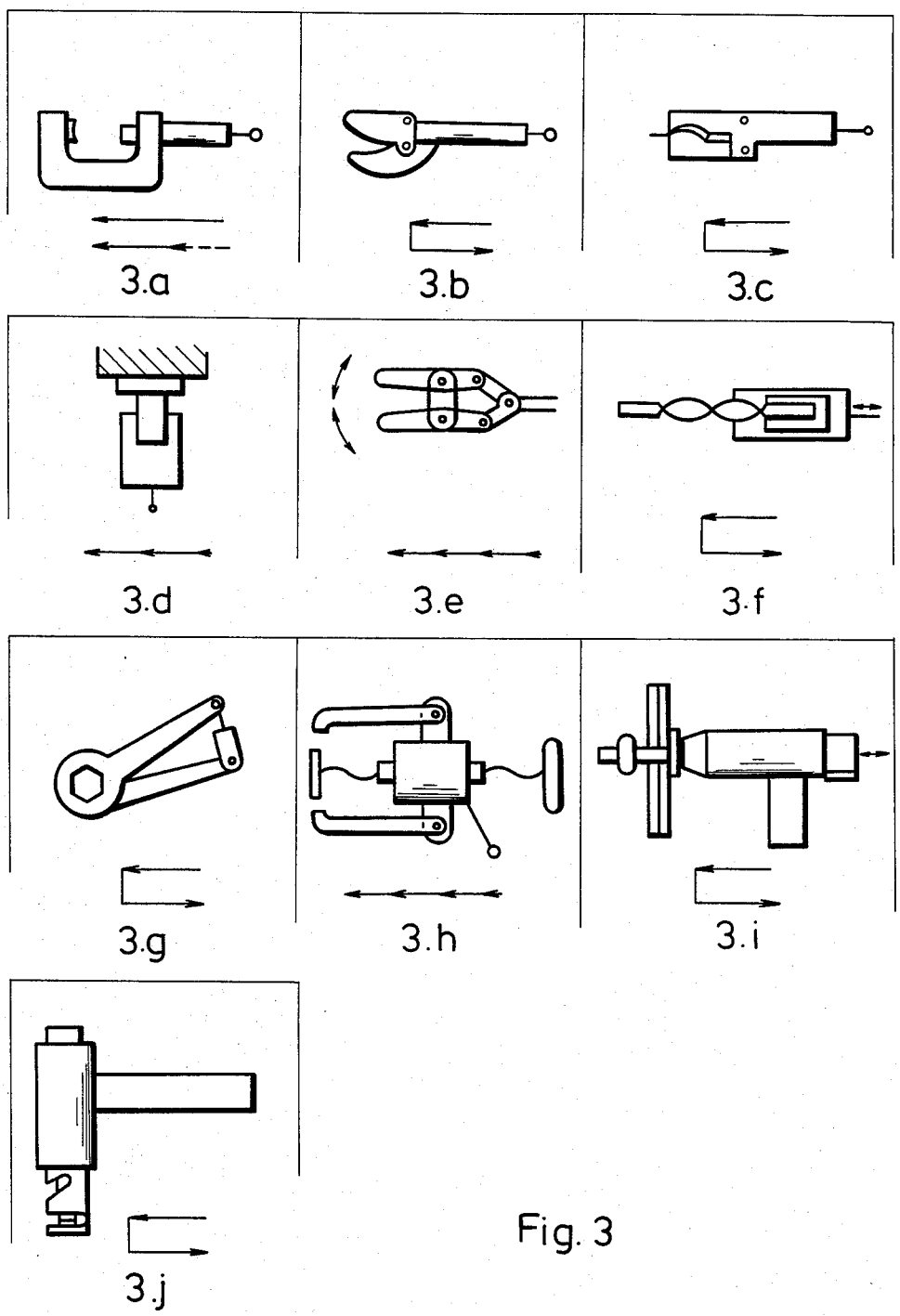

FIG. 3*a* is the schematic illustration of a riveting and pressing tool;

FIG. 3*b* is a schematic illustration of a cutting and scissor tool;

FIG. 3*c* is a tool for sheet metal forming;

FIG. 3*d* is a lifting tool;

FIG. 3*e* is a tensioning and cutting-up tool;

FIG. 3*f* is a tool for driving in screws;

FIG. 3*g* is a tool for pulling on a material;

FIG. 3*h* is a tool for the removal of a hub;

FIG. 3*i* is a rivet pulling tool;

FIG. 3*j* is a chiseling-plate-cutting device.

Figure 1:
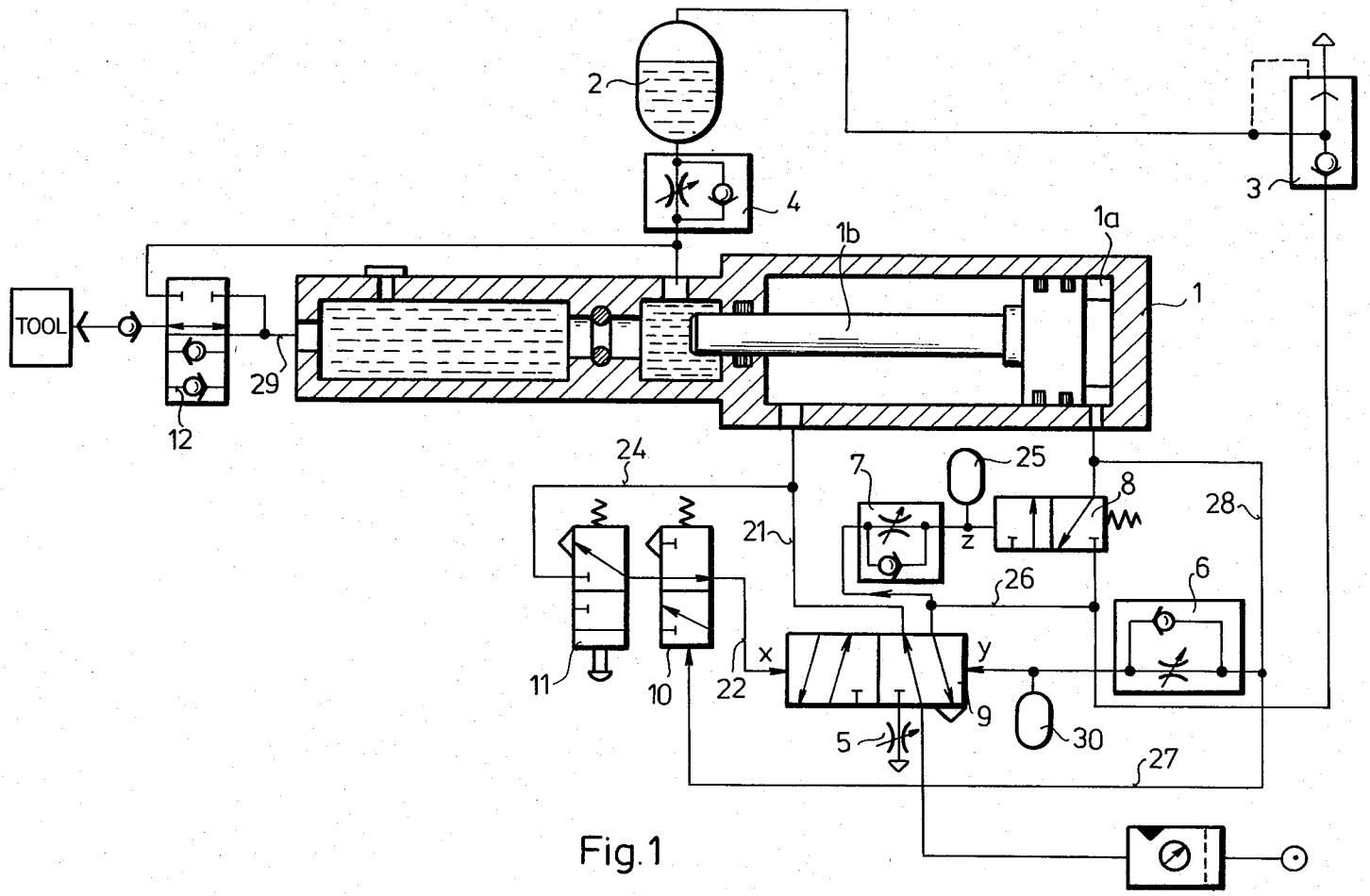
FIG. 1 is a schematic circuit arrangement of the pneumatically controlled pressure transducer according to the invention.

As can be seen from FIG. 1 the pneumatically controlled pressure transducer 1 of the present invention is provided with a tool operating cylinder, on one side of which there is a cylinder receiving the pneumatically operated piston 1*a*, while on the other side, the hydraulically operated cylinder is provided which receives the piston 1*b* built together with piston 1*a*. The primary space located before piston 1*a* of the pneumatically operated cylinder of the dual operating cylinder 1, is coupled with the two position control valve 9 over the conduit 21. The control valve 9 is connected over the air preparator with a pressurized air source, not illustrated in the drawing. The control valve 9 is coupled over conduit 22 and over the valve 10 with a starting valve 11. The other side of the starting valve 11 is connected over conduit 24 with conduit 21 which in turn connects the control valve 9 with the primary space located before the piston 1*a* of the pneumatically operated operating cylinder of the dual operating cylinder.

A further way of the control valve 9 is connected over the throttle-check valve 7 with a valve 8. Between the throttle-check valve 7 and the valve 8 the conduit of a buffer container 25 is connected. The control valve 9 is connected over a further conduit 26 to the branching-off conduit 27, which, on one side, is connected over a quick exhaust valve 3 with the hydraulic container 2, while on the other side, the conduit 27 is connected in the opposite direction over the valve 8 with the secondary space located behind the piston 1*a* of the pneumatic cylinder. The conduit between the valve 8 and the cylinder is, on one side in operating relationship with the valve 10 through a conduit 28, while on the other side, it is coupled over the throttle-check valve with the control valve 9. Between the throttle-check valve 6 and the control valve 9 the buffer container 30 is inserted.

The hydraulic container 2 is coupled over the throttle-check valve 4 with the hydraulic side of the dual operating cylinder in such a manner, that such coupling can be shut off by the piston 1*b*. In our embodiment such shutting-off will be realized in that the hydraulic cylinder is constructed in two parts and, between both parts there is provided a sealed transition for the piston 1*b*. By the insertion of the valve, the hydraulic cylinder can be coupled with various hydraulically operable working tools (see FIGS. 3*a*–3*j*). The hydraulic container 2 is coupled over the throttle-check valve 4 with the valve 12, and with the conduit 29 connecting the valve 12 with the hydraulic cylinder. The valve 12 is a valve which defines the operating process, that is, it determines either a single step or a function which repeats itself many times depending on the operation of the valve 11.

In the initial position of the pneumatically controlled pressure transducer, the air will retain the pneumatic piston 1*a* in its initial position at a pressure of 6 bar with the help of the control valve 9. Upon pressing down once the starter button of the starting valve 11, the control valve 9 will receive over the conduit 22 a control pressure indicated by X, obviously over the valve 10. Under the effect of the control pressure X, the control valve 9 will switch over, whereupon the primary side of the pneumatically operated cylinder will be connected to the atmosphere and the pressurized air will go over the quick exhaust valve 3 into the hydraulic container 2. Simultaneously the pressurized air will supply over the throttle-check valve a control pressure Z for the valve 8. Under the effect of the control pressure Z the valve will switch over, whereupon the pressurized air will go over to the secondary side of the pneumatic operating cylinder and will set the piston into a forward motion. Up to this time instant 1, the air entering the hydraulic container 2 will press, over the throttle-check valve 4, the oil under a pressure of 6 bar into the hydraulic cylinder, that is, through it into the operating tool which is connected thereto. Under the effect of the hydraulic pressure the operating tool will carry out a thrust motion, that is, it will move forward as long as the pressure is sufficient for such motion. Such phase can be considered essentially as a setting position. During its forward motion the piston 1*b* will, on one hand, close the path for the fluid which flows out of the hydraulic container 2, and thereafter the piston will let the oil under a pressure of about 150 bar into the operating tool, and as a consequence, it will carry out the operating stroke (cutting, pressing, etc.). The piston 1*b* will move forward as long until the operating tool will reach a closed postion, that is, until the control valve 9 will receive a control pressure Y over the throttle-check valve 6. Between the throttle-check valve 6 and the valve 9 a buffer container 30 is connected with its conduit, whereupon the system functions as a timing valve. Now the control valve 9 will switch back. The time $t_1$, which is between the pressing of the starter button up to the appearing of the control pressure Y, can be regulated by the throttle-check valve. The time $t_2$ of the quick forward stroke of the operating tool, that is, the movement up to the setting up position, is defined by the appearance of the control pressure Z, which can be set by the throttle-check valve 7 itself. The speed of the forward movement of the piston of the dual operating cylinder 1 is set by the throttle valve 5; the quick forward motion speed $t_2$ will be determined by the throttle-check valve 4.

Figure 2:
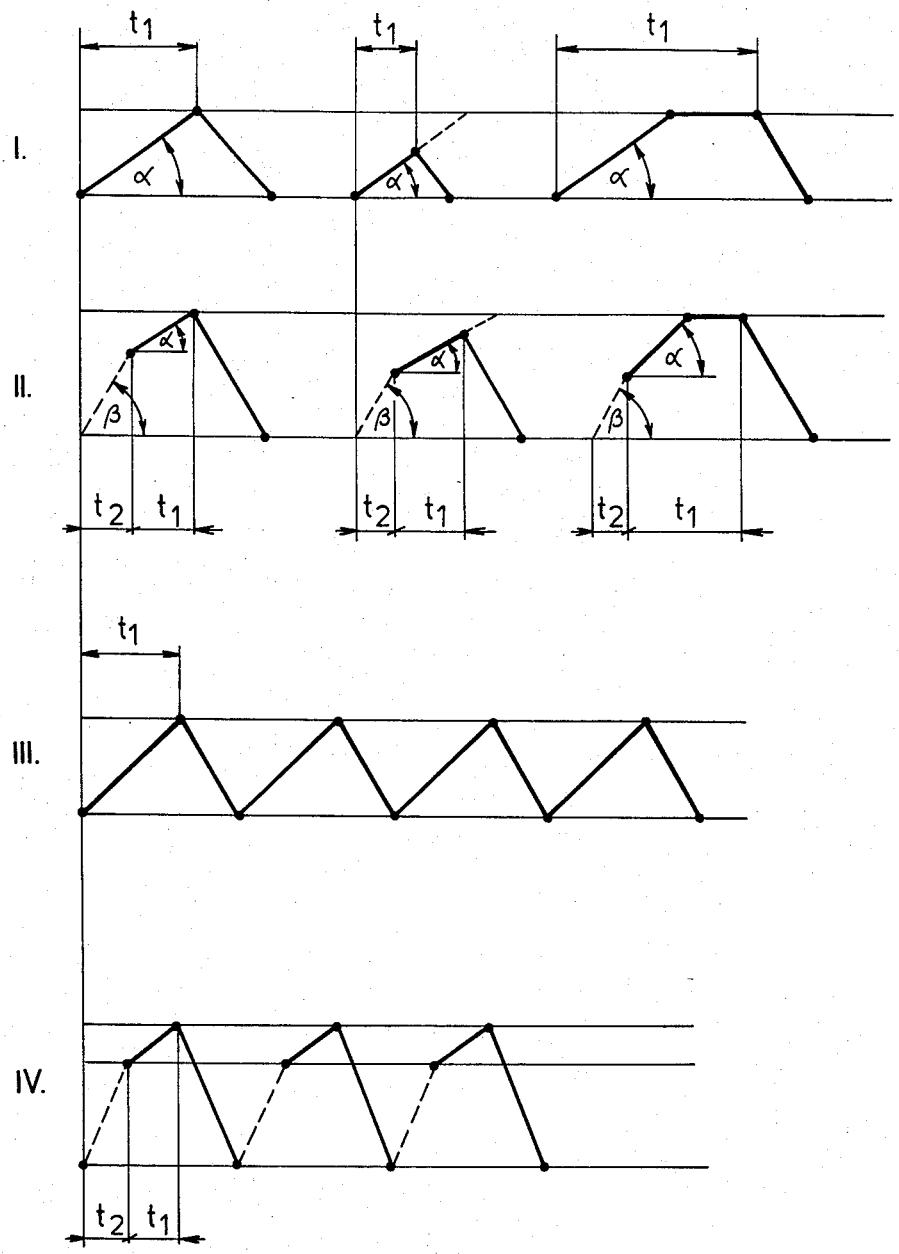
FIG. 2 is a distance-time diagram of four operating processes.

As follows from the above description, the flow control valves 4, 5 determine the speed, while the flow control valves 6, 7 determine the time and, they can be replaced by a timing valve of any type. The regulating possibility provided by the above-noted four flow control valves, 4, 5, 6, 7, will permit the different operating variations. Some examples for such variations are represented by FIG. 2 and illustrated by the so-called distance-time diagrams.

During the above-described operating procedure the pistons after a motion phase will return into their initial position. By the switching of the valve 12 the return of the piston is not connected with the automatic resetting of the operating tool in its initial position, inasmuch as the resetting will be prevented by the check valve present in the valve 12. Such operating process may, for example, be necessary during lifting, tensioning or removal of a hub. When the control signal Y appears at the control valve 9, it will switch back into its initial position and, as a result, the control system will empty itself and, the piston of the dual operating cylinder 1 will return under the effect of the air entering the primary side of the pneumatic operating cylinder, into its base or initial position.

When now the starting button of the starting valve 11 will become pressed in a continuous manner, the continuous repetition of the operating process will take place. Such operating process is necessary, for example, during the continuous cutting of sheet metals. Such operating process is illustrated in the distance-time diagram III-IV.

Obviously, the apparatus according to the present invention is not limited in any manner to the herein described embodiments; the apparatus can be coupled with a number of different operating tools inasmuch as the setting of the throttle-check valve will enable the realization of any operating process.

From the above it is clearly seen that the pneumatically controlled pressure transducer according to the present invention has a practically universal application in spite of its relatively simple construction.

We claim:

1. A pneumatically operated pressure transducer for the operation of a hydraulic work tool having a dual operating cylinder, on one side of which a pneumatically operable piston, on the other side a hydraulically operable piston is joined, comprising a control valve (9) coupled to a primary space located in front of the piston (1*a*) of the pneumatic cylinder of the dual operating cylinder, said control valve (9) being operatively coupled to a starter valve (11), the control valve (9) is coupled to a throttle-check valve (7) and said throttle-check valve (7) is coupled to a valve (8), said valve (8) connecting said control valve (9) to a quick exhaust waste valve (3) and to the hydraulic container (2) and with the secondary space of the pneumatic cylinder, a throttle-check valve (4) coupling said hydraulic container (2) to said hydraulic cylinder of the dual operating cylinder (1) in a fashion that said throttle-check valve (4) can be closed by the hydraulic piston (1*b*), and wherein a further throttle-check valve (6) is placed into a conduit (28) between the valve (8) and the cylinder (1) and couples said valve (8) and cylinder (1) into operating relationship with the control valve (9).

2. Pneumatically controlled pressure transducer according to claim 1, characterized in that between the starter valve (11) and the control valve (9) a valve (10) is inserted, said valve (10) being operated by the pressure existing in the conduit between the valve (8) and the cylinder (1).

3. Pneumatically controlled pressure transducer according to claim 1 characterized in that the throttle-check valves (4, 5, 6, 7) include means for at least partially adjusting the throttling.

4. Pneumatically controlled pressure transducer according to claim 1, characterized in that before the hydraulic cylinder into the conduit section adapted for coupling a hydraulic working tool thereto, there is a valve (12) inserted for determing the mode of operation.

* * * * *